United States Patent [19]

Bianchi et al.

[11] 4,178,862

[45] Dec. 18, 1979

[54] PROGRAMMED SEWING MACHINE WITH TWO CONNECTABLE AND DISCONNECTABLE NEEDLE BARS

[75] Inventors: Nereo Bianchi; Piergentino Zatti, both of Pavia, Italy

[73] Assignee: Necchi, S.p.A., Pavia, Italy

[21] Appl. No.: 568,027

[22] Filed: Apr. 14, 1975

[30] Foreign Application Priority Data

Apr. 12, 1974 [IT] Italy ..... 42903 A/74

[51] Int. Cl.[2] ..... D05B 19/00; D05B 1/08

[52] U.S. Cl. ..... 112/121.11; 112/163

[58] Field of Search ..... 112/121.11, 163, 121.12, 112/121.15, 2, 221

[56] References Cited

U.S. PATENT DOCUMENTS

| | | | |
|---|---|---|---|
| 3,074,632 | 1/1963 | Braun et al. | 112/121.11 X |
| 3,077,846 | 2/1963 | Bono | 112/163 X |
| 3,750,603 | 8/1973 | Martin | 112/121.11 X |

*Primary Examiner*—Peter Nerbun

*Attorney, Agent, or Firm*—Stevens, Davis, Miller & Mosher

[57] ABSTRACT

In a sewing machine with connectable and disconnectable needle bars driven by a motor for two needle stitching in different directions, a keyboard programmer and control device connected to the programmer to select the needle bar to be disconnected and the number of stitches to be sewn at low speed with only one needle, to shut down the sewing machine, to count the stitches number at the beginning of the sewing in the second direction to connect the needle for restarting the two-needle sewing and to switch the sewing machine back onto high speed. The device comprises two decade meters the first of which, at the end of the first stitches sewing counting, controls the machine shutdown and sends an advancing pulse to the second decade meter and, at the end of the second stitches counting, sends another pulse to the second decade meter which is switched to send a signal for the reconnecting of the needle bar and the de-energizing of the relay of the low speed.

2 Claims, 4 Drawing Figures

PROGRAMMED SEWING MACHINE WITH TWO CONNECTABLE AND DISCONNECTABLE NEEDLE BARS

The present invention relates to improvements in sewing machines with two connectable and disconnectable needle bars which are provided with a device for disconnecting the one or the other of said needle bars from the relative driving system. In sewing machines of this type, suitable to execute, contemporarily, with a pair of needles, two parallel seams on a fabric piece, when a changing of the seam direction was desired, it was necessary to disconnect the needle bar whose needle was forming an inner stitching in the original direction for a certain number of stitches, then with the sewing needle inside the fabric turn the fabric piece the desired angle with the presser foot lifted, sew again with the same outside needle for the same number of stitches, after lowering the presser foot, connect again the needle bar to the driving system and go on sewing in the new direction with both needles in operation.

A system for executing the mechanical disconnecting operation of one of the two needle bars has been described in U.S. Pat. No. 3,077,846.

This operation demanded operator skill to a high degree and also required a lot of time for the execution, because the operator had to operate the sewing machine manually acting on the handwheel to count accurately the necessary number of stitches depending upon the distance between needles and the angle formed by the two sewing tracts in different directions.

Therefore, it is an object of the present invention to take away from the operator's control the more difficult stages of the operating cycle described above in such a way as to reduce greatly the time and labor of the operator in the execution of the operation.

The objective of the invention, i.e., to change the sewing direction, the needle bar to be disconnected and the stitches number to be executed at low speed with only one needle is accomplished by selection on a keyboard programmer through which checking means are provided connected to the programmer and to the motor-stop to count automatically the stitches number at the end of the sewing in the first direction, the machine shutdown, the stitches number counting at the beginning of the sewing in the second direction, and the connecting of the needle bar for the restarting of the two-needle sewing and the machine stitching at high speed.

Further characteristics and advantages will be apparent from the following description of a preferred embodiment and from the attached drawings in which.

Figure 1:
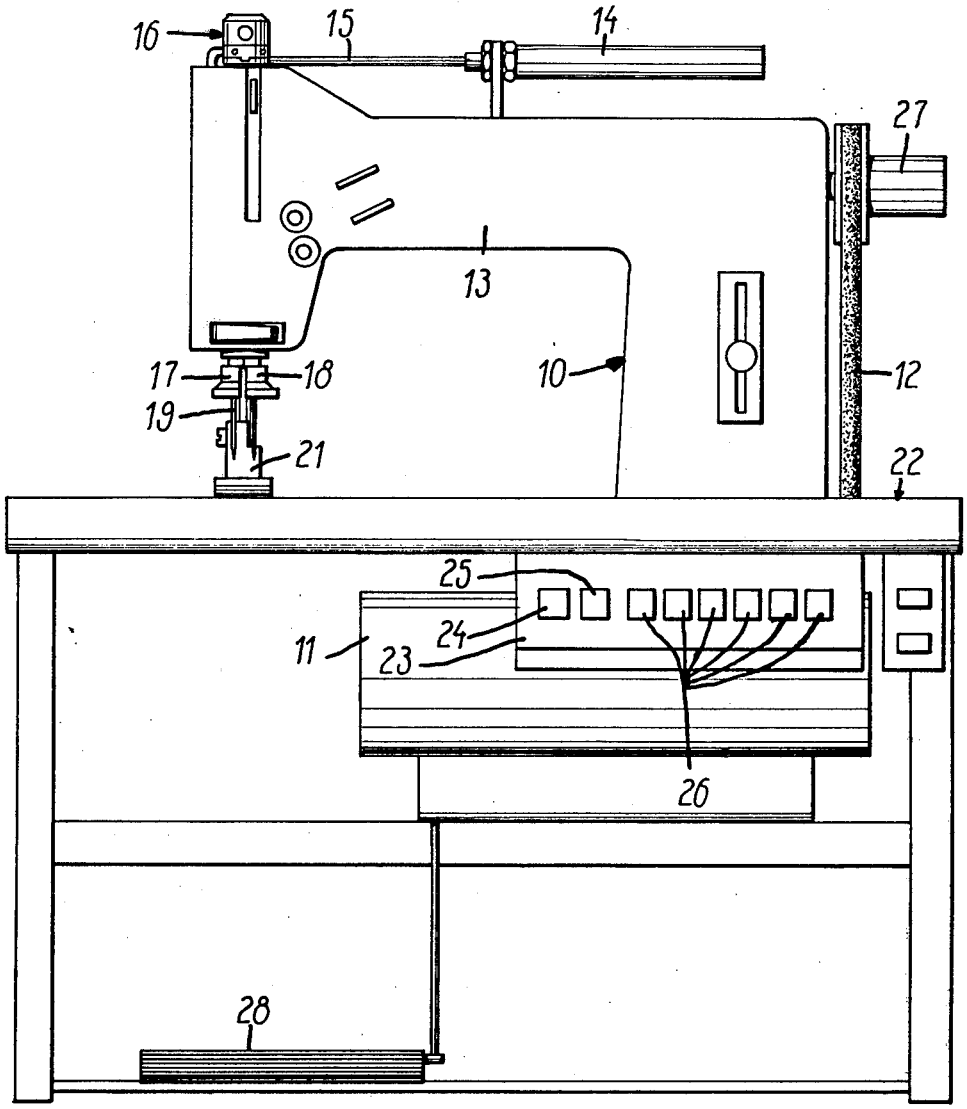
FIG. 1 illustrates a sewing machine having applied thereto the improvements of the invention.

With reference to FIG. 1 a sewing machine 10 is illustrated of the type having two connectable and disconnectable needle bars actuated by an electric motor of the "motor-stop" type through a driving belt 12. On top and behind the arm 13 of the sewing machine a pneumatic cylinder 14 is placed having a piston rod 15 attached to device 16 disconnecting the one or the other of the two needle bars 17 and 18 according to what has been widely described in U.S. Pat. No. 3,077,846. This disconnecting device 16 is used in executing double stitchings when changing direction according to predetermined angles.

Figure 2:
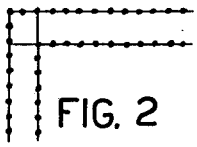
FIGS. 2 and 3 illustrate the sewing schemes obtainable with the sewing machine of FIG. 1.
Figure 3:
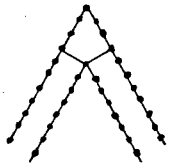

To perform the scheme as shown in FIG. 2 it is necessary to disconnect inner needle bar 18, make two stitches with needle bar 17, then with needle 19 inside the fabric and presser foot 21 raised, turn the fabric 90°, lower the presser foot again and sew two stitches more in the new direction. FIG. 3 shows another sewing scheme wherein the stitches to be executed with a needle bar disconnected are 3 plus 3.

According to the present invention the sewing machine 10 is positioned on a mounting 22 carrying a system for the setting up of the automatic cycle described above. Panel 23, for this purpose, is formed by a first set of two push-buttons 24 and 25 for the selection of the needle bar to be disconnected and by a second set of push-buttons 26 for the selection of the stitch number to execute twice according to what is described above. The sewing machine is provided with a reader 27 placed on the main shaft of the sewing machine to determine, according to a known technique, the machine stop with the needle in a pre-determined position. This reader is made in such a way as to send an electric impulse toward members, described hereinafter, at every revolution of the shaft.

Figure 4:
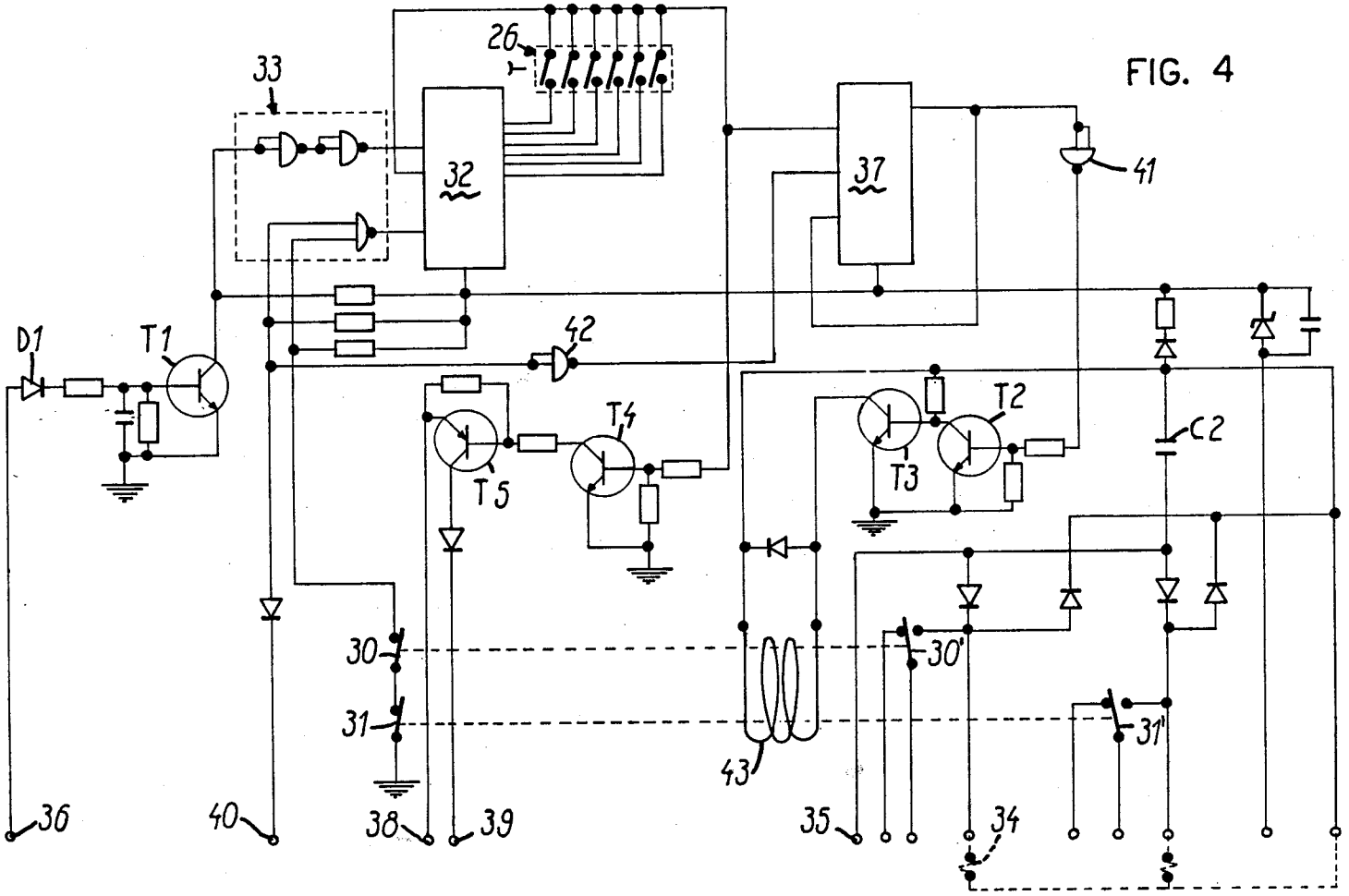
FIG. 4 illustrates the electrical layout comprising the control and driving means of the sewing machine of FIG. 1.

An example of the operating cycle is described hereinafter by referring to the electrical layout shown in FIG. 4.

The operator is carrying out a straight seam with the motor switched on the high speed, that is with treadle 28 completely pressed forward. When changing of the sewing direction is desired, the operator releases the treadle and the sewing machine stops with its needle inside the fabric. Now button 24 is pushed to disconnect needle bar 17. The first of the two contacts 30 of push-button 24 opens and pre-sets decade meter 32, through logic member 33, to receive pulses arriving from reader 27. By the operation of second contact 30', solenoid valve 34 is energized driving pneumatic cylinder 14 to disconnect needle bar 17. Also the motor low speed relay is energized, through clamp 35, so that the sewing machine will operate at low speed even if the operator, by mistake, should depress the treadle to the position corresponding to the high speed. The operator selects one of the push-buttons 26 connected to decade meter 32 in order to set the number of stitches, e.g., two, to be executed twice with the needle bar 17 disconnected. Upon operation of treadle 28 the sewing machine works at low speed and its reader sends to decade meter 32 a pulse for every revolution of the main shaft of the sewing machine. These pulses, through clamp 36 connected to reader 27, operative assembly formed by a transistor T1 and a diode D1 acting as amplifier and squarer of pulses, and logic member 33, reach decade meter 32. After a second pulse, a signal leaves decade meter 32 reaching through ways in parallel, the input of decade meter 32 to cause its shutdown, and the input of a second decade meter 37 to cause it to make a first jerk and through an amplifier assembly formed by transistors T4 and T5 to clamps 38 and 39 connected to the machine stop with its needle inside the fabric. The operator now actuates treadle 28 backward by her heel thus causing the presser foot lifting and contemporarily the arrival of a signal through clamp 40 to the input of decade meter 32 to clear it.

When heel pressure stops on the treadle, presser foot lowers again on the fabric owing to a return spring. Now the operator presses the treadle forward again and begins the second set of two stitches in the new direction on the fabric. After execution of the second stitch a signal starts from decade meter 32 as in the first stage, blocking up the same decade meter 32 and causes decade meter 37 to make a second jerk.

Decade meter 37 is pre-arranged, on receiving the second pulse to send a signal, through logic member 41 and the amplifier assembly formed by transistors T2 and T3, to electromagnet 43 for disconnecting push button 24. Contact 30' comes back to the position of FIG. 4 and de-energizes solenoid valve of cylinder 14. This way disconnected needle bar is now connected again. Contact 30 closes again and causes clearing of decade meters 32 and 37.

With a certain delay, due to the presence of condenser C2, owing to the opening of contact 30', the motor low speed relay is disconnected. The relay being connected to clamp 35 and the motor can work at high speed and restart normal sewing with two needles. Potential drop and grid bias resistances, stabilizer, arcing reducer and de-coupling diodes, equalization condensers shown in the electrical layout of FIG. 4 have not been described because their normal functions are not characterizing elements of the present invention.

What is claimed is:

1. In a sewing machine with two connectable and disconnectable needle bars the combination of a motor of the "motor-stop" type having a low and high speed, a keyboard programmer on the sewing machine assembly to select the needle bar to be disconnected and the stitches number to be sewn at low speed with one needle only, and control means connected to said programmer and to said motor-stop, said combination being so arranged to execute automatically, in changing of the sewing direction, a series of operations as follows:

(a) disconnecting one needle bar;
(b) operating the needle bar to sew a few stitches at low speed in the first direction;
(c) shutting down the machine;
(d) operating the needle bar to sew the same number of stitches as in stage (b) in the second direction;
(e) connecting the disconnected needle bar for restarting the two-needle sewing and switching the sewing machine back on high speed.

2. The sewing machine according to claim 1, wherein said control means are comprised of two decade meters the first of which, at the end of the first stitches sewing counting, controls the machine shutdown and sends an advancing pulse to the second decade meter and, at the end of the second stitches counting, sends another pulse to the second decade meter which is switched to send a signal for the reconnecting of the needle bar and the de-energizing of the relay of the low speed.

* * * * *